United States Patent [19]

Burns et al.

[11] Patent Number: 5,054,687

[45] Date of Patent: Oct. 8, 1991

[54] PRESSURE FEED PAINT CUP

[75] Inventors: Marvin D. Burns, Millbury; Albert S. Orr, Sylvania, both of Ohio

[73] Assignee: Ransburg Corporation, Indianapolis, Ind.

[21] Appl. No.: 494,175

[22] Filed: Mar. 14, 1990

[51] Int. Cl.[5] ..... B05B 9/04

[52] U.S. Cl. ..... 239/373; 239/337; 239/375; 222/396; 222/397; 222/400.7; 220/94 R

[58] Field of Search ..... 239/302, 337, 339, 373, 239/375; 222/396, 397, 400.7, 568/401, 468; 220/94 R, 94 A

[56] References Cited

U.S. PATENT DOCUMENTS

| | | | |
|---|---|---|---|
| 872,536 | 12/1907 | Nystrom | 222/568 |
| 1,520,998 | 12/1924 | Beach | 222/396 |
| 1,710,435 | 4/1929 | Shelburne | 222/396 |
| 1,929,348 | 10/1933 | Cathcart | 239/373 |
| 2,005,776 | 6/1935 | Downs | 239/289 |
| 2,848,996 | 8/1958 | Kowal | 222/630 |
| 2,880,940 | 4/1959 | Briggs | 239/526 |
| 2,934,246 | 4/1960 | Briggs | 239/289 |
| 3,090,530 | 5/1963 | Peeps | 222/400.7 |
| 3,240,398 | 3/1966 | Dalton | 222/630 |
| 3,507,309 | 4/1970 | Johnson | 239/308 |
| 4,298,045 | 11/1981 | Weiler et al. | 220/94 A |
| 4,760,962 | 8/1988 | Wheeler | 239/289 |

FOREIGN PATENT DOCUMENTS

| | | | |
|---|---|---|---|
| 837940 | 3/1970 | Canada | 222/396 |

OTHER PUBLICATIONS

Catalog sheet showing type KB pressure feed paint cup sold by The DeVilbiss Company.

*Primary Examiner*—Andres Kashnikow
*Assistant Examiner*—Christopher G. Trainor
*Attorney, Agent, or Firm*—MacMillan, Sobanski & Todd

[57] ABSTRACT

An improved pressure feed remote paint cup for use with a spray gun. The cup consists of a pressure tank with a large opening for filling and cleaning and a lid for closing the opening. The lid is secured to the tank with a separate threaded ring. The lid has an integral handle which facilitates holding from a point of balance during use. A pressure regulator and a pressure gauge are mounted on the handle.

10 Claims, 6 Drawing Sheets

PRESSURE FEED PAINT CUP

TECHNICAL FIELD

The invention relates to paint containers and more particularly to an improved pressure feed paint cup for supplying paint under pressure through a hose to a spray gun.

BACKGROUND ART

Typically, a hand held paint spray gun has an attached paint cup. When the sprayed paint is atomized with compressed air, most paints are delivered from the attached cup to a nozzle by suction feed. However, where the paint is too viscous, the cup may be pressurized to assure paint feed to the nozzle. There is a practical limit on the size of a paint cup which can be mounted on a hand held spray gun. As the capacity of the cup becomes larger, the gun becomes more unwieldy and the added weight can cause rapid operator fatigue. Further, a larger cup can obstruct use of the spray gun in tight quarters.

For applications where a larger cup is desired or where it is necessary to have the paint cup separate from the gun to permit use of the gun in tight quarters, remote paint cups have been available. The remote cup is connected to the air compressor to pressurize the cup sufficiently to cause paint to flow through a hose to the gun. One prior art remote pressurized paint cup has a lid mounting a pressure regulator and a pressure gauge for controlling the internal cup pressure and a wire bail for carrying the cup. The lid is secured on a pressure paint tank of an appropriate size. For filling and cleaning the cup, the lid is unscrewed from the pressure tank which holds the paint. It has been found that this cup can be improved. The cup can be awkward to use when it must be carried by the wire bail. The paint and air hoses attached to the lid can interfere with the position of the bail. Further, the wire bail was not comfortable when the cup was full of paint and, consequently, relatively heavy. For cleaning, it is sometimes difficult to unscrew the lid which may be sealed to the pressure cup with hardened paint. Further, the mouth of the pressure cup was not of a size which allowed any user to insert a hand into the cup to facilitate cleaning.

DISCLOSURE OF INVENTION

According to the invention, a pressure feed paint cup is provided with an improved handle for carrying during use and is designed to be more easily cleaned. The paint cup consists of a pressure tank and a lid for closing the pressure tank. The tank has an upper opening for filling and cleaning of a size for receiving an operators hand. External threads are formed on the tank around the opening. The lid fits over the opening and seals to the tank. The lid is releasably secured to the tank with a ring which engages the lid and threads onto a threaded neck on the tank. A low friction washer is positioned between the ring and the lid. Since paint in the tank never comes into contact with the ring, the ring may be easily unscrewed even when paint in the cup has began to harden at the seam between the lid and the tank.

An improved handle is integrally formed with the lid for carrying and holding the cup during use. The handle has a stem which projects generally vertically from one side of the center of the lid and then extends over the center of the lid in a direction substantially parallel to the lid. The handle may be slightly angled from the lid for carrying comfort. The handle has a free end which projects over the side of the tank and terminates at a fitting for connection to a compressed air supply hose. An air passage extends through the handle to the interior of the attached tank. A pressure regulator and a pressure gauge are mounted on or adjacent the vertical stem portion of the handle for adjusting the air pressure delivered to the tank. The handle has a second fitting for attaching an air hose to supply atomization air and/or pattern shaping air to the spray gun and the lid has a fitting for attaching a paint hose to supply paint to the spray gun. A rib projects downwardly from the handle for positioning between two fingers of an operator grasping the handle to prevent the paint cup handle from slipping. By selecting where the handle is grasped, the paint: cup may be balanced in the operator's hand to hang vertically. An optional hook is releasably secured to the handle to project above the handle for use, for example, for hanging the cup in a spray booth or from a ladder rung when the operator is on a ladder.

Accordingly, it is an object of the invention to provide an improved pressure feed paint cup.

Other objects and advantages of the paint cup will be apparent from the following detailed description and the accompanying drawings.

BEST MODE FOR CARRYING OUT THE INVENTION

Figure 1:
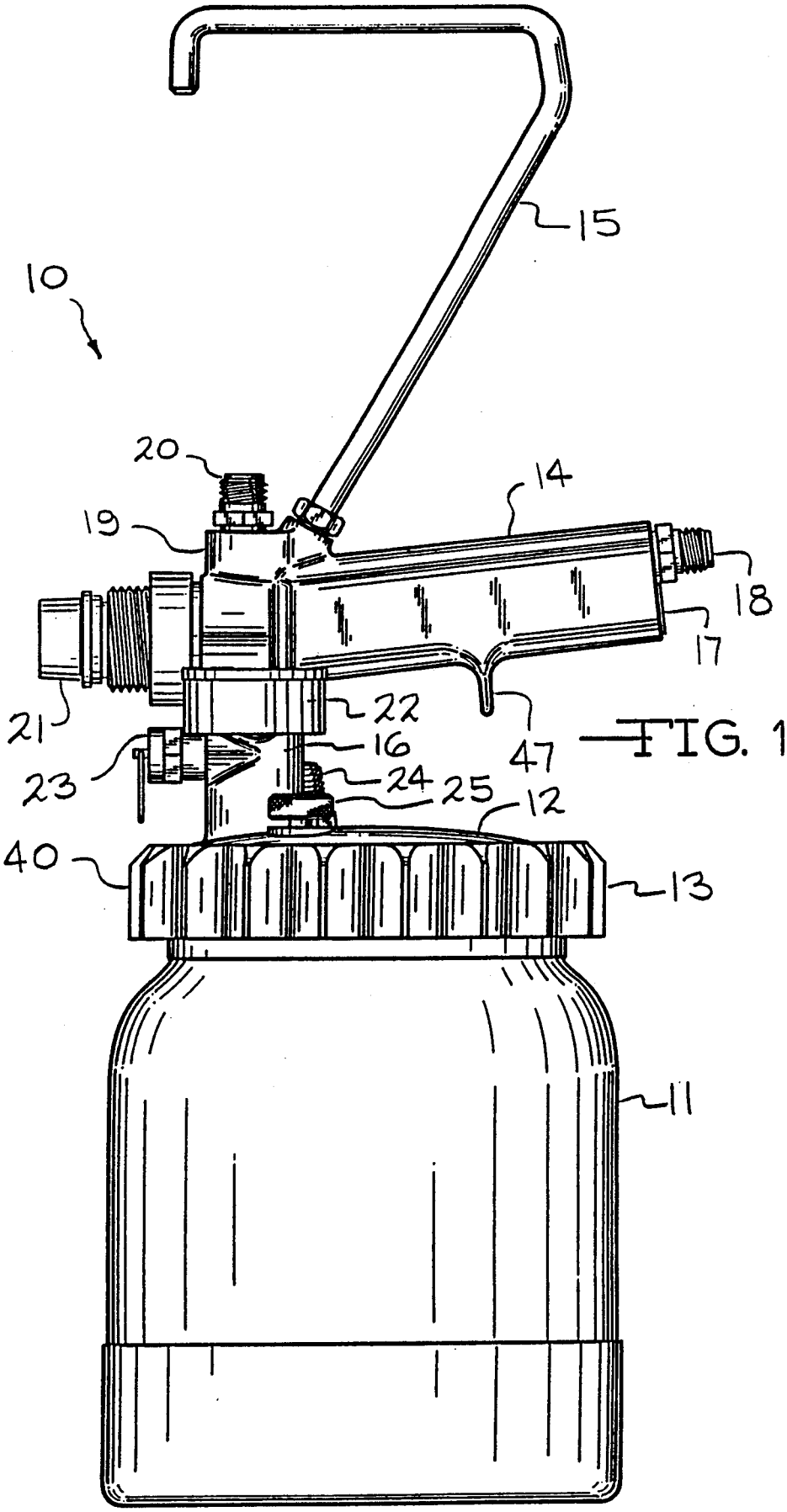
FIG. 1 is a side elevational view of an improved pressure feed paint cup according to the invention.
Figure 2:
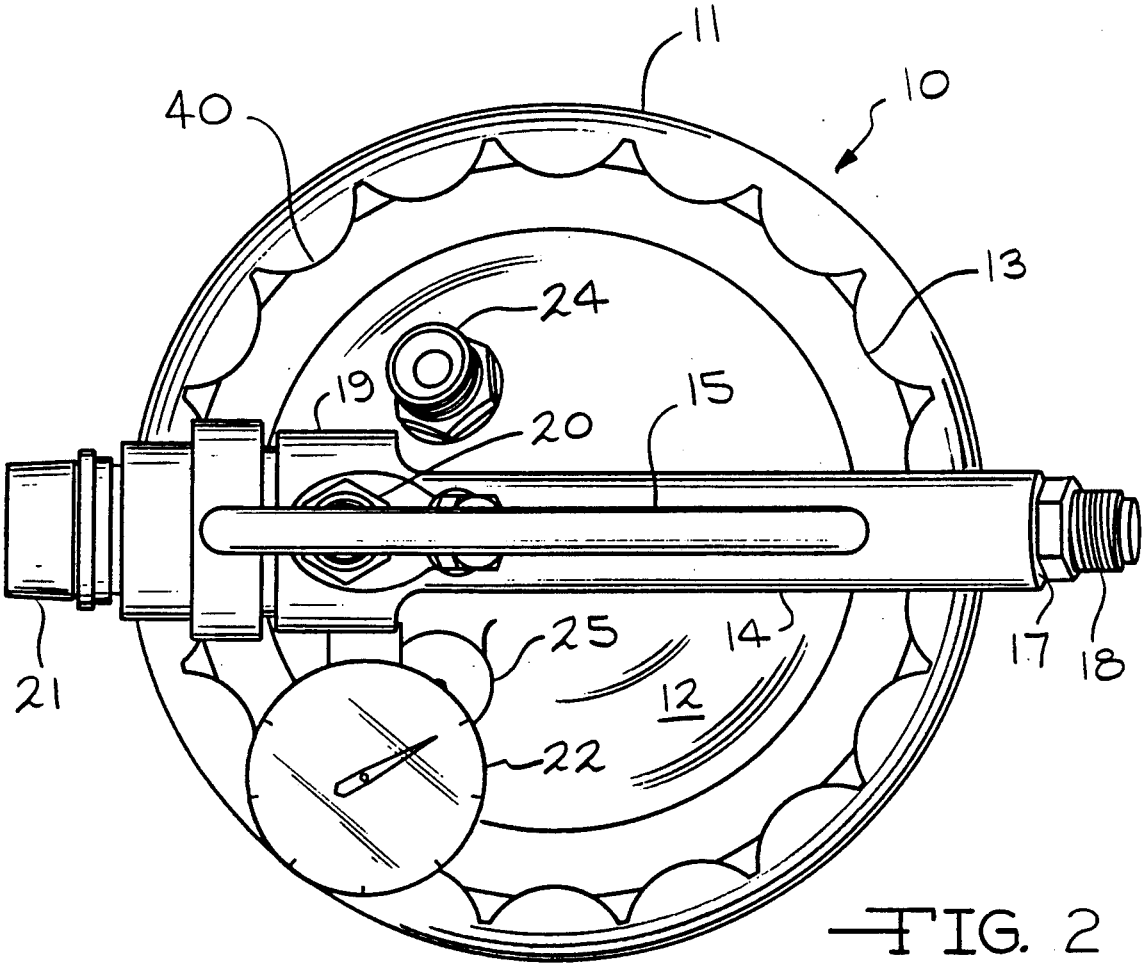
FIG. 2 is a top plan view of the pressure feed paint cup of FIG. 1.

Referring to FIGS. 1 and 2 of the drawings, a pressure feed paint cup 10 is shown according to the invention. The paint cup 10 generally consists of a paint tank 11, a lid 12 and a retainer ring 13 for releasably securing the lid 12 to the tank 11. The lid 12 includes an integral handle 14 for holding and carrying the paint cup 10. An optional hook 15 may be secured to the handle 14 for hanging the paint cup 10, for example, in a spray booth or from a ladder.

The handle 14 has a generally vertical step 16 extending from the lid 12 to a handle end 19. A compressed air inlet hose fitting 18 is secured to an opposite free end 17 on the handle 14. The free end 17 extends over the side of the tank 11. A compressed air outlet hose fitting 20 and a pressure regulator 21 are connected to the handle end 19. A pressure indicating gauge 22 and an over pressure safety relief valve 23 are mounted on the stem 16 between the regulator 21 and the tank 11. The lid 12 further includes a paint outlet hose fitting 24 and a manual pressure relief valve 25. In operation, an air hose from, for example, a shop air line or an air compressor (not shown) is connected to the handle fitting 18. Air received through the fitting 18 flows through the handle 14 and through the fitting 20 and a hose (not shown) to an atomization air and/or pattern shaping air inlet on a spray gun (not shown). The paint outlet fitting 24 on the lid 12 also is connected through a hose (not shown) to the spray gun. Prior to spraying, the pressure regulator 21 is adjusted to establish a desired pressure in the tank 11, as shown on the gauge 22. Spraying then takes place with paint supplied from the cup 10. When spraying is completed, the compressed air to the cup 10 is shut off at the source and the pressure in the tank 11 is vented by manually opening the valve 25. The ring 13 then may be unscrewed from the tank 11 to remove the lid 12 for dumping any remaining paint and for cleaning the cup 10.

Figure 3:
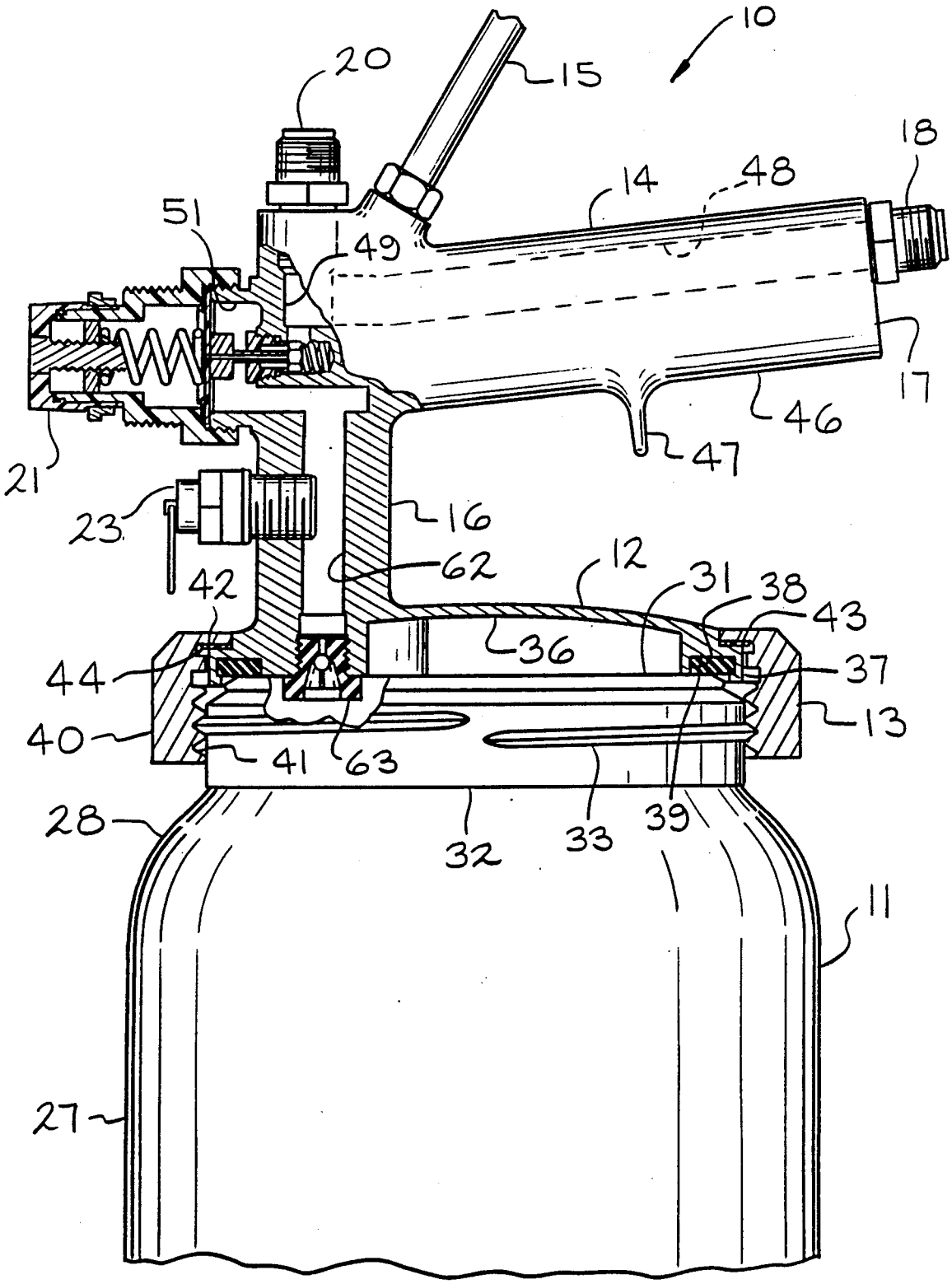
FIG. 3 is an enlarged fragmentary side elevational view, in partial section, of the pressure feed paint cup of FIG. 1.
Figure 4:
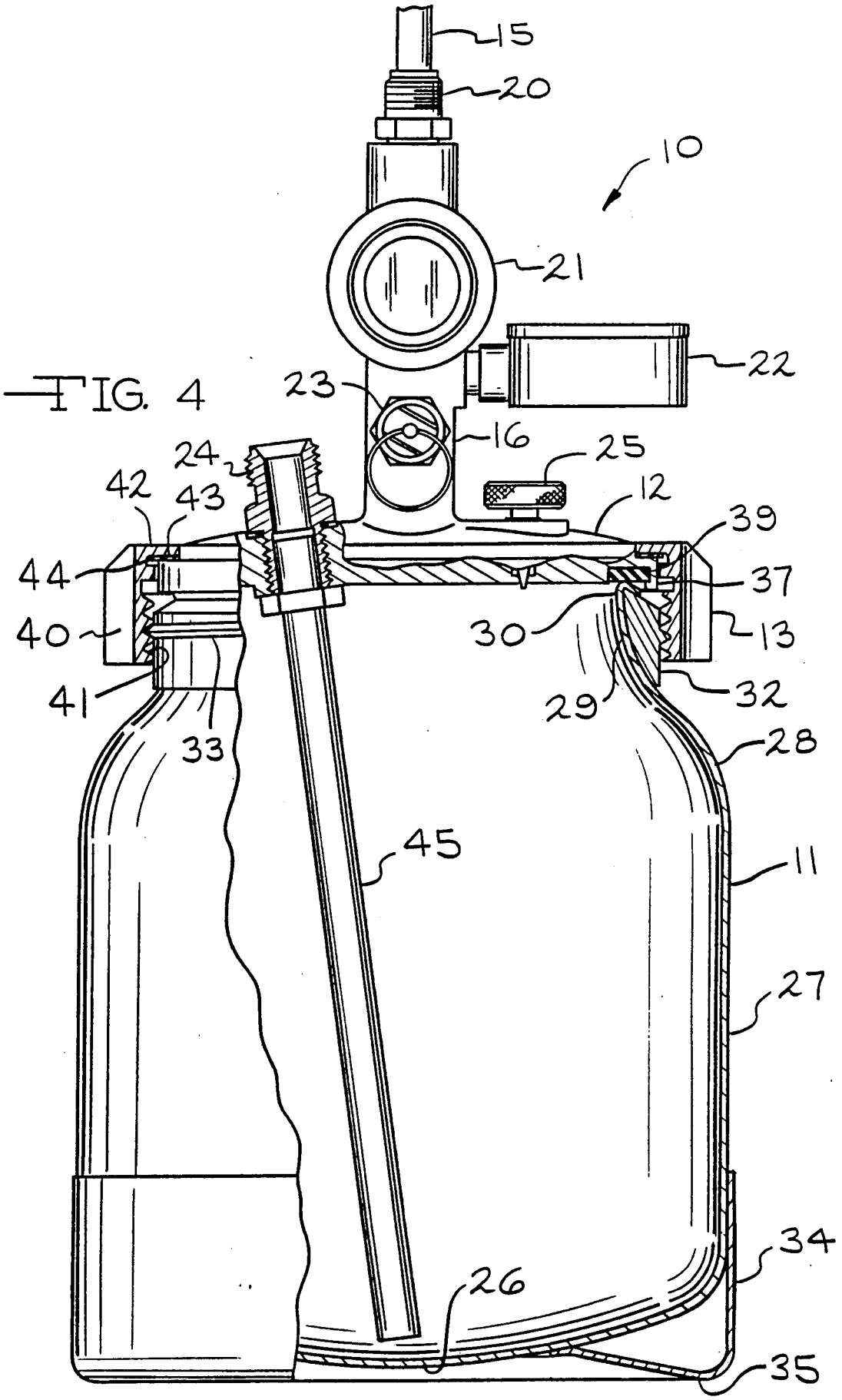
FIG. 4 is an enlarged fragmentary front elevational view, in partial section, of the pressure feed paint cup of FIG. 1.

FIGS. 3 and 4 show details of the tank 11 and the way the lid 12 is secured to the tank 11 with the ring 13. The tank 11 is formed from a suitable material such as an aluminum alloy and has a bottom 26, a cylindrical side 27, a shoulder 28 and a neck 29 surrounding a mouth 30. The neck 29 includes an upper lip 31 bent over a reinforcement ring 32 having external threads 33. The bottom 26, side 27, shoulder 28 and neck 29 are rounded in accordance with conventional pressure vessel technology so that the tank 11 is safe against rupture at a high internal pressure. A skirt 34 is secured to the tank bottom 26 and side 27 to provide a stable annular surface 35 to allow the paint cup 10 to stand in an upright position. The tank mouth 30 should have a sufficiently large diameter to allow an operator to insert his or her hand for cleaning the tank 11. Preferably, the mouth 30 is at least 10 centimeters in diameter.

The lid 12, including the integral handle 14, is preferably a machined die casting of an aluminum alloy. The lid 12 has a slightly domed center 36 which extends over the tank mouth 30 to a rim 37. A lower annular groove 38 formed in the rim 37 receives a resilient gasket 39. When the lid 12 is secured on the tank 11, the gasket 39 forms a pressure seal between the lid 12 and the upper lip 31 on the tank 11. The retainer ring 13 has a scalloped outer edge 40 to facilitate turning when securing the lid 12 to or removing the lid 12 from the tank 11. The ring 13 has an internal thread 41 which engages the tank neck thread 33 to secure the lid 12 on the tank 11. A radially inwardly directed flange 42 on the top of the rim 13 has a diameter less than the maximum diameter of the lid rim 37. When the rim 13 is positioned on the lid 12, the flange 42 engages a flat annular surface 43 on the top of the lid rim 37. A low friction washer 44, for example, of Delrin acetal resin, is positioned between the flange 42 and the adjacent surface 43 to facilitate rotating the ring 13. As is shown in FIG. 4, when the lid 12 is secured to &:he tank 11, a paint tube 45 attached to the hose fitting 24 extends from the lid 12 to adjacent the tank bottom 26.

The use of a separate ring 13 for securing the lid 12 to the tank 11 has a distinct advantage over prior art pressurized paint cups in which the lid is screwed directly to the neck of the tank. During an extended period of use, paint in the cup may collect at the seam between the tank 11, the seal 39 and the lid 12 and may harden. The hardened paint will make it difficult to unscrew the lid. With the paint cup 10, any hardened paint between the tank 11, the seal 39 and the lid rim 37 will not interfere with unscrewing the ring 13. Once the ring 13 is unscrewed, a stuck lid 12 may be pulled or pried from the tank lip 31 much easier than unscrewing a stuck prior art paint cup lid.

Figure 5:
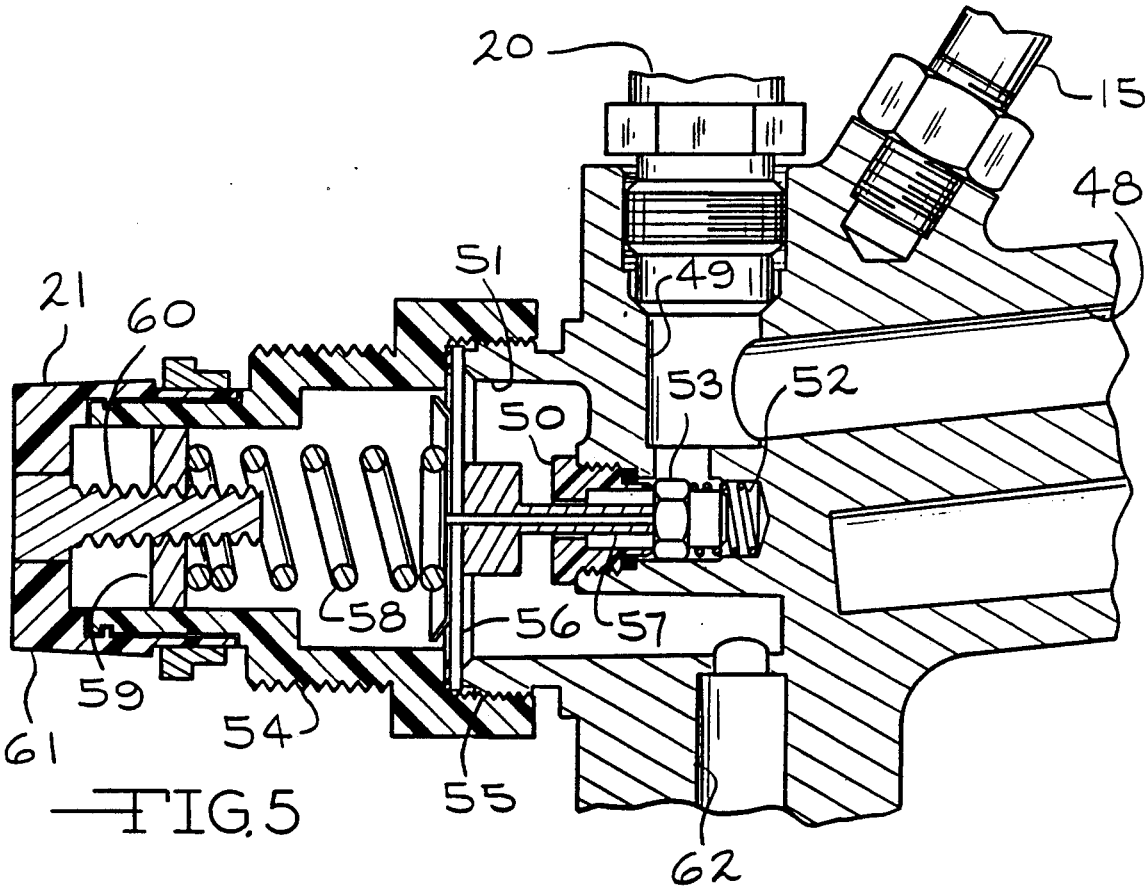
FIG. 5 is an enlarged fragmentary cross sectional view through a portion of the handle and the regulator valve for the pressure feed paint cup of FIG. 1.

FIGS. 3 and 5 show details of the construction for the handle 14 and the pressure regulator 21. The handle stem 16 extends upwardly from the lid 12 from adjacent the rim 37. The handle 14 has a pistol type grip 46 which may be similar to a conventional spray gun handle, except that the grip 46 extends substantially horizontally at all times. The grip 46 extends from the stem 16 over the center of gravity of the paint cup 10 to the projecting end 17. A rib 47 projects downwardly from the center of the grip 46 in a direction towards the domed lid center 36. The rib 47 is positioned to extend between two fingers of an operator grasping the handle grip 46. By selecting the proper position for the rib 47 in the hand, the paint cup 10 will be balanced in the operator's hand. By attaching the compressed air supply hose to the free end 17 of the handle grip 46, the weight of the hose merely moves the balance point along the grip 46. Thus, the paint cup 10 can be well balanced in the hand against the weight of the cup 10 and of an air hose attached to the free handle end 17.

An air passage 48 extends through the grip 46 from the air hose fitting 18 to a chamber 49. The spray gun air hose fitting 20 connects to the chamber 49. A valve seat 50 for the regulator 21 is located in the stem 16 between the chamber 49 and a chamber 51. A spring 52 is located in the chamber 49 to press a valve 53 against the seat 50 to normally prevent the flow of compressed air from the chamber 49 to the chamber 51. The regulator 21 has a bonnet 54 which is threaded onto a portion 55 of the stem 16 which surrounds the chamber 51 to clamp a flexible diaphragm 56 between the bonnet 54 and the stem portion 55. The diaphragm 56 closes an open side to the chamber 51. A hollow rod 57 projects from the center of one side of the diaphragm 56 through the seat 50 and contacts the valve 53. On the other side of the diaphragm, a compression spring 58 extends between the diaphragm 56 and a nut 59 which is threaded onto a screw 60. The screw 60 is secured to a cap 61 which rotates on the bonnet 54. By rotating the cap 61, the nut 59 is moved toward or away from the diaphragm 56 to increase or decrease the pressure exerted by the spring 58 on the diaphragm 56. The diaphragm 56 balances the air pressure in the chamber 51 exerted over the area of the diaphragm 56 against the applied spring pressure. If the spring pressure is greater, the diaphragm 56 causes the rod 57 to move the valve 53 from the seat 50. Compressed air will then flow from the chamber 49 to the chamber 51 until the air pressure is sufficient to move the diaphragm 56 until the valve 53 is again seated on the seat 50.

The chamber 51 is connected through a passage 62 and a check valve 63 to the interior of the tank 11. Accordingly, the tank 11 will have the same pressure as the chamber 51. The check valve 63 allows air to flow from the passage 62 to the tank 11, while preventing paint flow from the tank 11 into the passage 62 where such paint could damage the regulator 21. The over pressure safety valve 23 also is mounted on the stem 16 to vent excessive air pressure from the passage 62.

Figure 6:
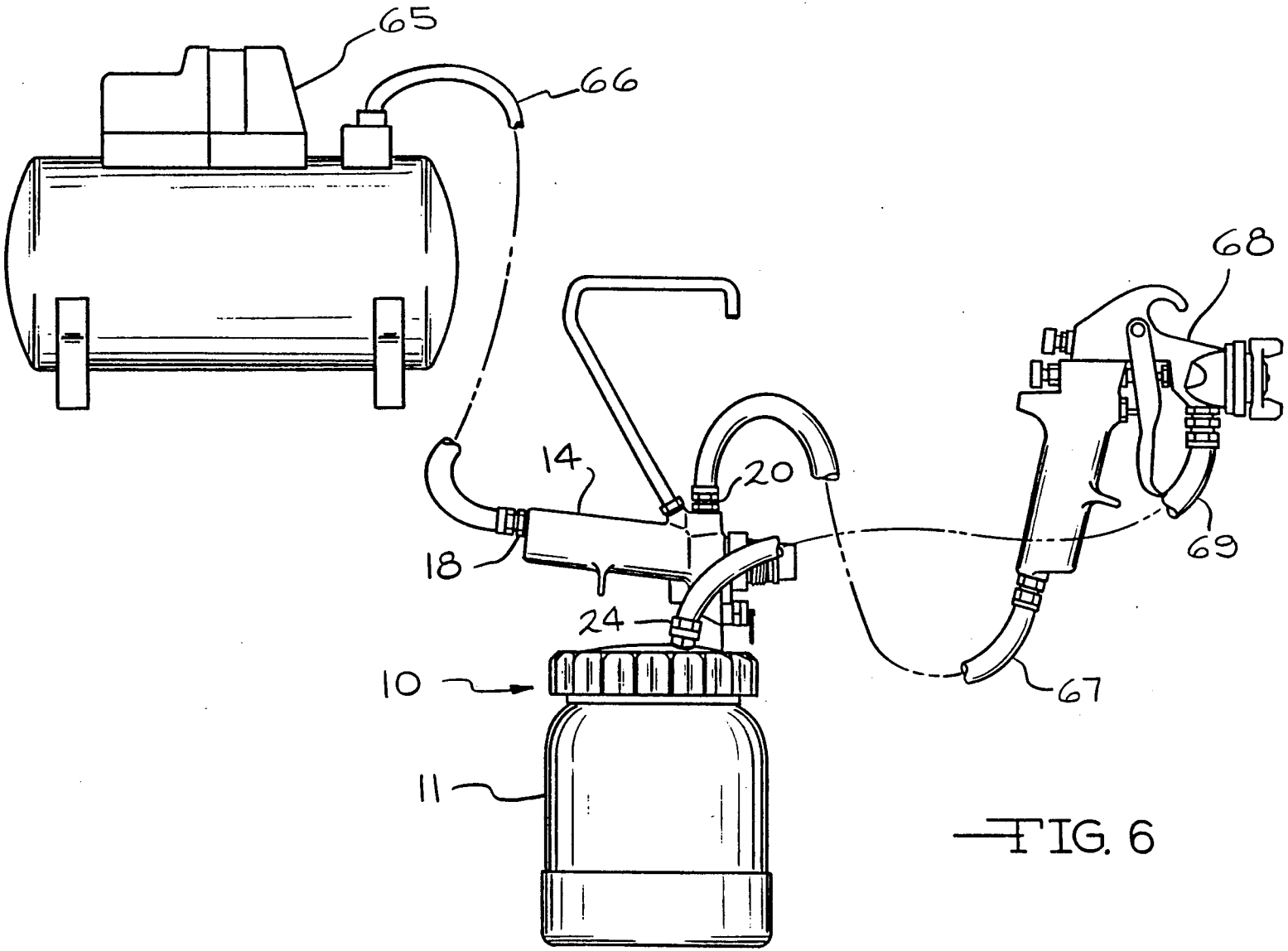
FIG. 6 is a diagrammatic view showing the pressure feed paint cup of the invention connected to an air compressor and a paint spray gun to form a paint spray system.

FIG. 6 is a diagrammatic view of a paint spray system 64 incorporating the pressure feed paint cup 10 of the invention. An air compressor 65 is connected through a hose 66 to the fitting 18 on the paint cup handle 14. Compressed air delivered through the hose 66 pressurizes the tank 11 and also is delivered through a hose 67 attached to the fitting 20 to an air inlet on a spray gun 68. The regulator 21 is used to set a desired tank pressure and the actual tank pressure is indicated on the gauge 22. The air supplied through the hose 67 to the spray gun 68 may be used for paint atomization and/or for spray pattern shaping. Finally, a paint supply hose 69 is connected between the paint cup fitting 24 and the spray gun 68. During use, the paint cup 10 may be set on the floor, picked up by the handle 14 or hung from the hook 15.

It will be appreciated that various changes and modifications may be made in the above described pressure feed paint cup 10 without departing from the spirit and the scope of the following claims.

What is claimed is:

1. An improved pressure feed paint cup comprising a pressure tank, said tank having an upper opening for receiving paint and for cleaning, said tank having an externally threaded neck surrounding said opening, a lid adapted to fit over said tank opening, internally threaded ring means adapted to fit over and engage said lid and to engage said external neck threads for releasably securing said lid on said tank, means for forming a pressure seal between said lid and said tank when said lid is secured to said tank, a handle integrally formed with said lid, said handle having a stem projecting from one side of the center of said lid and a grip extending substantially parallel to said lid and over the center of said lid whereby the center of gravity for said cup and its contents is vertically under said handle, and means for supplying compressed air through said handle to pressurize said tank.

2. An improved pressure feed paint cup, as set forth in claim 1, wherein said handle grip diverges slightly away from said lid and wherein a rib projects from said handle grip toward said lid and is positioned to extend between two fingers of an operator's hand grasping said handle grip during use of said paint cup.

3. An improved pressure feed paint cup, as set forth in claim 2, wherein said handle grip has a free end projecting past said tank and an air hose fitting attached to said free end, and wherein said means for supplying compressed air supplies such compressed air through said fitting and said handle to said tank.

4. An improved pressure feed paint cup, as set forth in claim 3, and further including air pressure regulating means secured to said handle, said regulating means controlling the pressure of the compressed air supplied through said handle to pressurize said tank.

5. An improved pressure feed paint cup, as set forth in claim 4, and further including a second air fitting on said handle, and means for supplying compressed air from said handle through said second air fitting to a spray gun, and means for supplying paint from said tank to such spray gun.

6. An improved pressure feed paint cup, as set forth in claim 4, and including check valve means for preventing fluid flow from said tank to said regulating means.

7. An improved pressure feed paint cup, as set forth in claim 6, and further including an over pressure safety valve means between said regulating means and said check valve means, and manual valve means in said lid for manually venting air pressure from said tank.

8. An improved pressure feed paint cup, as set forth in claim 7, and further including a support hook, and means for removably securing said support hook to said handle adjacent said second air fitting.

9. An improved pressure feed paint cup, as set forth in claim 1, wherein said tank opening is at least 10 centimeters in diameter.

10. An improved pressure feed paint cup, as set forth in claim 1, wherein said ring means has a central opening for receiving said lid and a reduced diameter annular flange engaging said lid, and further including a low friction washer between said lid and said annular flange.

* * * * *